US005858031A

United States Patent [19]

Perlman

[11] Patent Number: 5,858,031

[45] Date of Patent: Jan. 12, 1999

[54] ISOPROPANOL BLENDED WITH AQUEOUS ETHANOL FOR FLAME COLORATION WITHOUT USE OF SALTS OR HAZARDOUS SOLVENTS

[75] Inventor: Daniel Perlman, Arlington, Mass.

[73] Assignee: Brandeis University, Waltham, Mass.

[21] Appl. No.: 889,339

[22] Filed: Jul. 8, 1997

[51] Int. Cl.[6] ..... C10L 1/18

[52] U.S. Cl. ..... 44/452; 44/642

[58] Field of Search ..... 44/642, 452

[56] References Cited

U.S. PATENT DOCUMENTS

| | | | |
|---|---|---|---|
| 4,383,836 | 5/1983 | Wilson et al. | 44/452 |
| 4,405,336 | 9/1983 | Badger | 44/438 |
| 4,436,525 | 3/1984 | Zmoda et al. | 44/266 |
| 4,932,979 | 6/1990 | Thrasher et al. | 44/379 |
| 4,992,041 | 2/1991 | Kewish et al. | 431/126 |
| 4,997,457 | 3/1991 | Mitsusawa et al. | 44/642 |
| 5,127,922 | 7/1992 | Bension | 44/275 |
| 5,147,413 | 9/1992 | Kiovsky et al. | 44/642 |
| 5,266,080 | 11/1993 | Kiovsky et al. | 44/642 |

FOREIGN PATENT DOCUMENTS

| | | |
|---|---|---|
| 2690689 | 3/1991 | France . |
| 4065489 | 5/1990 | Japan . |

*Primary Examiner*—Ellen M. McAvoy
*Attorney, Agent, or Firm*—Lyon & Lyon LLP

[57] ABSTRACT

A method for enhancing the visibility of a flame produced during free-burning of an aqueous alcohol-based fuel composition in air. The fuel composition is substantially free of skin-irritants, corrosive salts and agents which, when burned in air, produce air pollution evidenced by the production of volatile organic compounds. The fuel includes between approximately 10% and 30% by volume of water, and between approximately 70% and 90% by volume of a mixture of alcohols including ethanol and isopropanol, the ethanol constituting between approximately 24% and 83% by volume of the fuel composition. The method includes providing an amount of isopropanol ranging between approximately 7% and 60% by volume of the fuel composition, in which the volume ratio of isopropanol to ethanol in the fuel does not exceed 2:1.

14 Claims, No Drawings

ISOPROPANOL BLENDED WITH AQUEOUS ETHANOL FOR FLAME COLORATION WITHOUT USE OF SALTS OR HAZARDOUS SOLVENTS

BACKGROUND OF THE INVENTION

This invention relates to the field of alcohol-based fuel products and flame-coloration components therein.

None of the references cited herein are admitted to be prior art to the present invention, but are provided solely to assist the understanding of the reader.

Ethanol has become an increasingly popular fuel which, when denatured, can be commercially sold for use in, for example, alcohol stoves. Ethanol is also used in combination with other fuels such as gasoline to produce "gasahol". Denatured ethanol (such as standard denatured alcohol-SDA 3-A which includes 5 volumes of methanol combined with 100 volumes of ethanol) burns cleanly in air in an open container or dish, producing a partially blue, principally yellow flame which is visible in bright sunlight. Although the yellow color may suggest oxygen limitation, no soot or volatile organic compounds (VOCs) are produced.

Several commercially available fuels utilize denatured ethanol diluted with water, perhaps the most common ones combining denatured ethanol, water, and a gelling agent. For example, one gelled fuel contains approximately 65–70% by volume ethanol, and is packaged in metal cans which can be placed under food vessels such as chafing dishes and then ignited (e.g., Sterno®-brand fuel manufactured by Colgate-Palmolive, Tenafly, N.J.). The lack of flame visibility with this fuel and other similar water-containing alcohol-based fuels can lead to accidental burn injuries and fire damage because of the lack of awareness that the ethanol is burning. While it might seem straightforward to add something to ethanol to make its flame visible, there are severe limitations on the use of such an additive. For example it should be of low toxicity and substantially non-polluting, i.e., low in emission of volatile organic compounds, as the fuel burns. Such an additive should also persist in the ethanol as long as any combustible ethanol remains, i.e., throughout the burning cycle of the ethanol, so that flame coloration is sustained.

Several ethanol-based fuel compositions which contain a variety of chemicals for producing flame coloration and for increasing the fuel's flash point (above the ethanol flash point of 55° F.) have been described. For example, Badger in U.S. Pat. No. 4,405,336 describes an alcohol fuel composition containing a final concentration of ethyl alcohol ranging between 79.4% and 87.7% by volume, formulated from at least 90%, i.e., 180 proof ethyl alcohol. The maximum concentration of water in the composition is 8.85% by volume. The composition contains a mixture of methyl isobutyl ketone, kerosene, xylenes, and isopropanol. The isopropanol is present at a level of between 1.6% and 4.3% final concentration. All of the ingredients are reported to raise the flash point and increase the visibility of the flame. The xylenes and the isopropanol are reported to mask odors. However, the overall composition is highly toxic (e.g., xylene) and irritating to the skin, and produces a significant amount of smoke and volatile organic compounds when burned.

Balland et al. in FR 2,690,689 describe a flame coloring system for an alcohol burner. A coloring salt such as a borate is added to the liquid, solid or gelled alcohol fuel, e.g., methanol, ethanol or propanol, which is positioned at the appropriate air flow inlet. Successful flame coloration depends upon the positioning of the coloring agent relative to air flow apertures in the burner. The salts are used at high concentrations, e.g., 2–20% by volume or weight, and are either very caustic (NaOH) and corrosive to burner hardware, or are toxic and polluting as metal salts (copper, strontium, antimony).

In JP 4,065,489, a fuel is described which generates a colored flame. The fuel contains a 1–4 carbon lower alcohol (methanol, ethanol, propanol, or butanol), up to 15% by weight water, and water-soluble salts which function as flame colorants when added at moderately high concentrations. The metal salts tend to be orrosive to burner hardware, and add cost to the fuel.

SUMMARY OF THE INVENTION

The present invention concerns sustained flame coloration of aqueous ethanol-containing fuels which are free-burned, providing a method for enhancing and sustaining flame visibility and also providing suitable fuels. Free-burning of a fuel is defined as combustion of the fuel in an open reservoir or on an open surface in the ambient air , e.g., combustion of the fuel in an open cup or canister, in a dish, on a sheet of aluminum foil or in an open airspace on the bottom of a barbecue grill or in a fireplace, or the like. Such combustion does not require adjustable hardware to regulate air and fuel flow such as in an alcohol stove. Sustained flame coloration or sustained flame visibility refers to continuous flame color throughout the burn cycle, i.e., until the fuel is substantially exhausted.

When alcohols containing three or more carbons, e.g., propyl, isopropyl and butyl alcohols, are free-burned as pure or aqueous diluted fuels, they produce a yellow and typically sooty flame. However when the one and two carbon lower alcohols, methanol and ethanol are free-burned, they tend to produce flames with very little color. Absolute methanol produces a faint bluish flame, while ethanol produces a slightly yellowish flame.

Applicant has observed that upon addition of water to ethanol (at least 10% by volume water), the combustion rate of the alcohol in air diminishes, and the highly visible yellow flame is replaced by a faint blue flame. While the blue flame color indicates complete combustion with an ample supply of oxygen, the flame is difficult to see in bright sunlight and poses the danger of accidental burn injuries.

The danger of accidental burn injuries can be reduced by making the flame more easily visible. This can be accomplished by the addition of flame colorants. It was found that isopropyl alcohol (abbreviated IPA) could be added to ethanol in sufficient amount to provide useful flame coloration without the toxic components or air polluting effects of some previously utilized colorants. A final concentration of at least approximately 7% by volume IPA, and preferably 10% or more IPA should be added to obtain such flame visibility. The water content of the fuel is preferably at least 10% by volume in order to reduce the rate of alcohol combustion during free-burning, but should not exceed 30% by volume to allow adequate flame heat output for igniting wood and charcoal. Accordingly, for a fuel containing a total of between 70% and 90% by volume alcohol (total IPA plus ethanol content), the water content should range between approximately between 10% and 30% by volume. The ratio of IPA to ethanol in this mixed aqueous alcohol system can vary widely and still produce a yellow-colored flame without soot production, but the ratio of IPA to ethanol should not exceed 2 volumes IPA to 1 volume ethanol. The ethanol concentration can range between approximately 30% and 83% by volume, and the IPA can range between approximately 7% and 60% by volume. Thus, a mixture with maximum ethanol content would contain 83% ethanol, 7% IPA, and 10% water, while a mixture with minimum ethanol content would contain 30% by volume ethanol, 40% to 60% by volume IPA and 10% to 30% by volume water. A yellowish flame which produces very little if any smoke or soot results from such combustion.

Thus, in a first aspect, the invention features a method for enhancing and sustaining the visibility of a flame produced during free-burning of an aqueous alcohol-based fuel composition in air by providing a particular type of fuel composition. The fuel composition is substantially free of skin-irritants, corrosive salts and agents which, when burned in air, produce air pollution evidenced by the production of volatile organic compounds. The fuel includes between approximately 10% and 30% by volume of water, and between approximately 70% and 90% by volume of a mixture of alcohols including ethanol and isopropanol. The ethanol constitutes between approximately 24% and 83% by volume of the fuel composition. The fuel includes an amount of isopropanol ranging between approximately 7% and 60% by volume of the fuel composition, in which the volume ratio of isopropanol to ethanol in the fuel does not exceed 2:1.

In a preferred embodiment, the fuel composition includes between approximately 10% and 20% by volume water, and between 80% and 90% by volume of a mixture of alcohols including ethanol and isopropanol. The ethanol constitutes between approximately 27% and 83% by volume of the fuel composition and the isopropanol constitutes between approximately 7% and 53% by volume of the fuel composition. The volume ratio of isopropanol to ethanol in the fuel does not exceed 2:1.

In some preferred embodiments, the fuel composition further includes a thickening agent to reduce the flow and seepage rates of the fuel, and to at least partially immobilize the fuel after it has been transferred from its storage container to the location where it is to be burned. When desired, the thickening agent can be used to completely immobilize the fuel.

In preferred embodiments, the thickening agent is a hydrocolloid thickening agent, such as a cellulosic thickening agent which is soluble in a fuel composition containing up to 90% by volume of a mixture of alcohols described above in the first aspect of the invention. A particular example of a thickening agent is hydroxypropylcellulose such as KLUCEL type H (manufactured by Hercules, Inc., Aqualon Division, Wilmington, Del.). In a related aspect, the invention provides a fuel composition as is described above. Thus, the fuel composition includes between approximately 70% and 90% by volume of a mixture of alcohols including ethanol and isopropanol. The ethanol constitutes between approximately 24% and 83% by volume of the fuel composition and the isopropanol constitutes between approximately 7% and 60% by volume of the fuel compositions. And the volume ratio of isopropanol to ethanol does not exceed 2:1. A fuel composition also includes between approximately 10% and 30% by volume water. In preferred embodiments, the fuel contains between 10% and 20% by volume/water, between approximately 27% and 83% by volume ethanol and between approximately 7% and 53% isopropanol. One particularly useful composition for lighting barbecue charcoal and fireplace logs contains approximately 65% by volume ethanol, 20% by volume isopropanol and 15% by volume water. KLUCEL-Type H (at a concentration of between approximately 1.0% and 1.5% (weight over volume)) can be dissolved in this blended aqueous alcohol composition to thicken the composition, immobilizing the fuel even on top of previously burned ash found on the bottom of a charcoal grill beneath charcoal to be ignited, or on the floor of a fireplace beneath logs to be ignited.

Also as indicated above, the fuel composition includes a thickening agent such as a hydrocoloid thickening agent. A preferred example, is a cellulosic thickening agent, such as hydroxypropylcellulose such as KLUCEL) Type H. Also, in preferred embodiments, the fuel composition consists essentially of the mixture of alcohols and water as described above; in further preferred embodiments, the fuel composition also consists essentially of the mixture of alcohols and water as described above, and a thickening agent as described.

Other features and advantages of the invention will be apparent from the following description of the preferred embodiments, and from the claims.

DESCRIPTION OF THE PREFERRED EMBODIMENTS

As described in the Summary above, the present invention concerns sustained flame coloration of aqueous ethanol-containing fuels which are free-burned, for example with the fuel in an open reservoir or on an open surface in the ambient air, e.g., combustion of the fuel in an open cup or canister, in a dish, on a sheet of aluminum foil, on previously burned ash, or in an open airspace on the bottom of a barbecue grill or in a fireplace, or the like. Sustained flame coloration or sustained flame visibility refers to continuous flame color throughout the burn cycle, i.e., until the fuel is exhausted, or at least substantially exhausted, e.g., at least 80, preferably at least 90, and more preferably at least 95% exhausted.

As described above, the free-burning of alcohols containing three or more carbons, e.g., propyl, isopropyl and butyl alcohols, as either pure fuels or diluted with water produces a yellow and typically sooty flame. In comparison, the free-burning of the one and two carbon lower alcohols, methanol and ethanol, generally produces flames with very little color. Absolute methanol produces a faint bluish flame, while ethanol produces a slightly yellowish flame. In the present invention, ethanol is a preferred fuel because of its lower volatility, lower toxicity, and higher heat of combustion than methanol, and its environmental status as a renewable and biodegradable resource.

The addition of water to the ethanol (at least 10% by volume water) to form an aqueous fuel results in a reduced rate of combustion in air and the formation of a faint blue flame instead of the slightly yellow flame. As stated above, the blue flame color is difficult to see in bright or moderately bright ambient light conditions and consequently poses the danger of accidental burn injuries.

However, as used in the present invention, water is a useful diluent to increase the flash point of ethanol, which thereby increases the safety of transporting and using ethanol-based fuels. Water also beneficially reduces the rate of combustion of this alcohol and thereby extends the duration of combustion of a given amount of alcohol. This extended time is important when the alcohol is used as a lighter fluid to ignite other fuels, such as wood and charcoal. As indicated, Applicant has found that with ethanol, when approximately 10% or more (by volume) of water is added to the fuel, the rate of combustion decreases and the yellow flame color disappears. It is believed that with water addition to the fuel, the additional heat required to evaporate the water during the ethanol volatilization, reduces the fuel's temperature and, in turn, the rate of alcohol vaporization and combustion. With less ethanol vaporizing, the oxygen demand of the fire is reduced and the flame therefore burns "cleaner", i.e., without any yellow color. Therefore, in the present invention the rate of combustion of free-burning absolute ethanol is reduced (and the flash point increased) by adding water to a final concentration of between 10% and 30% by volume. The concentration of alcohol is thereby reduced to between 70% and 90% by volume.

Regardless of whether ethanol is free-burned in liquid or gelled form, when a substantial concentration of water is present, i.e., more than approximately 10% by volume, ethanol (unlike isopropanol) burns with an essentially colorless or faint blue flame which is very difficult to see in bright sunlight. For example, Applicant has tested two commercial products which utilize gelled ethanol as a free-burned heating fuel for chafing dishes (Sterno® brand "canned heat cooking fuel" containing approximately 65–71% ethanol, 3% methanol and 25–30% water manufactured by Colgate-Palmolive Company, Tenafly, N.J., and a similar product, Blaze®, manufactured by Aaper Alcohol, Shelbyville, Ky.). It is observed that both fuels burn with only faint blue flames which are difficult to see in bright room light or in daylight. Without the visual evidence of a bright flame, it is easy to make the mistaken assumption that the fuel is not burning, and accidental burn injuries may ensue. In a co-pending patent application, U.S. Ser. No. 08/661,630, Perlman utilizes non-polluting ethanol fuels to ignite barbecue charcoal by placing a quantity of such a fuel under the charcoal, and then igniting the fuel. No means is described for enhancing the visibility of the flame.

In order to reduce the accidental burn danger, it is therefore advantageous to have a more visible colored flame for an ethanol-based fuel. However, it is also preferable to not use a flame colorant which is toxic, irritating to the skin, or produces substantial soot or organic combustion products. For example, it has been found that the combination of chemical agents, methyl isobutyl ketone, kerosene, xylene and isopropanol, which was described in Badger, U.S. Pat. No. 4,405,336 for addition to ethanol, is irritating to the skin and produces a substantial amount of soot (smoke) and volatile organic compounds when burned. Furthermore, the flame coloring agent should be free of corrosive and toxic salts which become airborne or remain as pollutant residues following combustion of the fuel (compared to the additives of Balland, FR 2,690,689).

Therefore, Applicant has searched for a flame coloring agent which would be compatible with aqueous ethanol and which would be neither a skin irritant, nor highly toxic, nor polluting when burned. Applicant's search focused on volatile agents of low to moderate toxicity. More specifically, an agent was sought which could form a constant boiling mixture with aqueous ethanol, or possessed a boiling point similar to the ethanol-water azeotrope (b.p.=78° C.), so that it could co-volatilize with the ethanol, and continue to be present in the ethanol-containing fuel throughout the combustion cycle to provide sustained flame coloration.

It has been discovered that isopropanol (abbreviated IPA for isopropyl alcohol) which has a boiling point of 82° C., and which is a standard denaturant for ethanol (5 volumes IPA plus 100 volumes ethanol produces SDA 3C denatured ethanol), can be added at a higher concentration to a quantity of aqueous ethanol to provide flame visibility throughout the free-burning cycle of the fuel. Although the percentage by volume of IPA required to obtain adequate flame visibility (defined as the ability to see a flame in bright sunlight) varies somewhat with the water content of the fuel, the SDA 3C formulation containing approximately 4.8% by volume IPA does not produce adequate flame visibility. A final concentration of at least approximately 7% by volume IPA, and preferably 10% or more IPA should be added to obtain such flame visibility. The water content of the fuel is preferably at least 10% by volume to reduce the rate of alcohol combustion during free-burning, but should not exceed 30% by volume to allow adequate flame heat output for igniting wood and charcoal. The preferred effective composition ranges for a fuel containing ethanol, isopropanol, and water are described in the Summary above.

A particularly useful characteristic of the IPA plus ethanol mixture is its coordinated combustion, i.e., its "co-combustion", during free-burning in an open vessel in air. For example, we have studied other candidate blends for clean-burning alcohol fuels, such as IPA blended with methanol, and these blends do not exhibit co-combustion during free-burning. Thus, an equal volume blend of IPA and methanol initially bums with a pure blue flame characteristic of methanol, and subsequently with a smoky flame characteristic of IPA. It is believed that the increased volatility of methanol (boiling point, 65° C.) compared to IPA (boiling point, 82° C.) results in its early combustion. The discovery of the successful co-combustion of IPA mixed with ethanol, and the provision of continuous flame visibility as long as fuel is present, can now be understood when placed in the context of the observations described above for the methanol-IPA blend.

It is believed that because IPA and ethanol have very similar boiling points (82° C. and 78° C. respectively), and even similar heats of vaporization ($H_v$=10,064 and 9,674 g·cal per g·mole respectively), they tend to co-volatilize during free-burning, and thereby co-combust in proportion to their relative abundance.

It has been observed that SDA 3-C alcohol in the absence of water burns with a somewhat yellow flame. However, in the presence of water, i.e., 10% or more by volume of water, tests have shown that unless the proportion of IPA is increased above 5% (e.g., to a 7% level and preferably to a level of 10% or above), the flame is not adequately visible in bright sunlight. Accordingly, for a Sterno®-type of fuel containing approximately 65% to 70% ethanol and 3% methanol, it is suggested that the composition be altered to approximately 55% ethanol and 15% IPA. SDA 3-C denatured ethanol containing approximately 5% IPA can be used as a starting component to formulate this altered composition.

As described, the present invention remedies several problems associated with ethanol fuel formulations engineered to produce visible flames. These problems include skin irritancy, fuel toxicity, and the production of volatile organic compounds and smells associated with fuels containing various other organic compounds, and the salt residue, corrosiveness and cost associated with the use of metal or inorganic salts. The importance in meeting or surpassing governmental clean air standards for free-burned fuels through the use of aqueous ethanol-IPA blends is also significant. Particularly in urban and suburban environments where residents live in close proximity to one another, the use of VOC-free ethanol-based lighter fuels rather than conventional mineral spirits, to ignite barbecue charcoal is desirable. Similarly, it is desirable to use a non-polluting rather than a polluting agent to provide flame color.

While the ethanol-based fuels described above can be used as liquid mixtures, for some applications it is beneficial if the fuel composition also includes a thickening agent to reduce the flow and seepage rates of the fuel, and to at least partially immobilize the fuel after it has been transferred from its storage container to the location where it is to be burned.

While a variety of thickening agents are available, in preferred embodiments the thickening agent is a hydrocolloid thickening agent. In particular, a cellulosic thickening agent can appropriately be used which is soluble in a fuel composition containing up to 90% by volume of a mixture of alcohols as described above. An example of a thickening agent is hydroxypropylcellulose such as KLUCEL type H (manufactured by Hercules, Inc., Aqualon Division, Wilmington, Del.) which can be added to various final concentrations depending on the desired final thickness, but preferably to a final concentration of between approximately 1.0% and 1.5% (weight/volume). However, a variety of other thickening agents can be used as known to those skilled in the art. Preferably the thickening agent is non-toxic and does not produce a substantial amount of volatile organic compounds on burning in a fuel composition as described herein.

The examples below show the effects on flash point and flame characteristics resulting from the addition of water and isopropanol to ethanol.

EXAMPLE 1

Addition of Water to Ethanol Reduces Flame Visibilitv

Moderate concentrations of water (approximately 5% to 30% by volume of the combined solution) were added to absolute ethanol for increasing the flash point and reducing the rate of combustion of this fuel under free-burning conditions in air. Small scale free-burning tests on ethanol and aqueous dilutions of ethanol were carried out utlizing 2.0 milliliter samples of each alcohol solution. The samples were ignited in open aluminum cups measuring 3.3 cm in diameter×0.8 centimeter tall. Results were as follows:

| Sample | Percent Water (by volume) | Flash Point (°F.) | Description of Flame |
|---|---|---|---|
| 1 | 0 | 55 | bright yellow, fast-burning |
| 2 | 5 | 60 | similar to sample 1 |
| 3 | 10 | 68 | somewhat yellow, intermediate burn rate |
| 4 | 15 | 73 | light blue to colorless, slower burning |
| 5 | 20, 25, and 30 | 75–80 | similar to sample 4 |

Conclusions: Approximately 10% by volume water is required to significantly decrease the combustion rate of ethanol in air. At this level of water and above, the yellow color of the flame and its visibility in bright sunlight are dramatically diminished. A suitable flame colorant is needed if accidental burn injuries are to be avoided.

EXAMPLE 2

Isopropanol (IPA) Provides Flame Visibility in an Aqueous Ethanol Fuel

Increasing concentrations of IPA (5% to 25% by volume) were combined with decreasing concentrations of absolute ethanol (and a constant water concentration of 15% by volume) to produce samples containing a constant total alcohol concentration of 85% by volume. Small scale free-burning tests were carried out in open aluminum cups as in Example 1, utilizing 2.0 milliliter samples of each solution. Results (with flame visibility in bright sunlight) were as follows:

| Sample | % IPA (by vol) | % ethanol (by vol) | % water (by vol) | Description of Flame |
|---|---|---|---|---|
| 1. | 0 | 85 | 15 | light blue to colorless |
| 2. | 5 | 80 | 15 | similar to sample 1 |
| 3. | 10 | 75 | 15 | significantly yellow, easily visible |
| 4. | 15 | 70 | 15 | somewhat yellower than sample 3 |
| 5. | 20 | 65 | 15 | similar to sample 4 |
| 6. | 25 | 60 | 15 | similar to sample 4 |

Conclusions: Addition of 10% by volume IPA provides significant flame coloration in an 85% by volume alcohol (IPA plus ethanol) fuel composition containing 15% water. All samples were clean-burning with no detectable odor or soot production.

EXAMPLE 3

Minimum but Sufficient Isopropanol Content for Flame Visibility in an Aqueous Ethanol Fuel Increasing concentrations of IPA (5% to 10% by volume) were combined with decreasing concentrations of absolute ethanol (and a constant water concentration of 15% by volume) to produce samples containing a constant total alcohol (IPA plus ethanol) concentration of 85% by volume. Small scale free-burning tests were carried out in open aluminum cups as in Examples 1 and 2, utilizing 2.0 milliliter samples of each solution. Results (with flame visibility in bright sunlight) were as follows:

| Sample | % IPA (by vol) | % ethanol (by vol) | % water (by vol) | Description of Flame |
|---|---|---|---|---|
| 1. | 0 | 85 | 15 | light blue to colorless |
| 2. | 5 | 80 | 15 | similar to sample 1 |
| 3. | 6 | 79 | 15 | similar to sample 1 |
| 4. | 7 | 78 | 15 | noticeably yellow |
| 5. | 8 | 77 | 15 | noticeably yellow |
| 6. | 9 | 76 | 15 | yellower than samples 4 and 5 |
| 7. | 10 | 75 | 15 | slightly yellower than sample 6 |

Conclusions: Addition of as little as 7% by volume IPA provides noticeable flame coloration in an 85% by volume alcohol (IPA plus ethanol) fuel composition containing 15% water. Ten percent (or more) by volume IPA provides superior flame coloration however.

EXAMPLE 4

Free-Burned 100% IPA and IPA Diluted with Water Produce Soot

Small scale free-burning tests of IPA and aqueous dilutions of IPA were carried out in open aluminum cups as in Examples 1, 2 and 3 utilizing 2.0 milliliter samples. Decreasing concentrations of IPA (100% maximum to 70% minimum by volume) were combined with increasing concentrations of water (between 0% and 30%), and the samples were ignited. All samples produced sooty bright yellow flames. Conclusions: Even when diluted with water to reduce its rate of combustion, IPA fails (under free-burning conditions) to burn cleanly in air. The highly visible yellow flame is sooty.

EXAMPLE 5

Limit on Isopropanol Concentration in Aqueous Ethanol Fuel to Avoid Substantial Soot Production Increasing concentrations of IPA (0% to 57% by volume) were combined with decreasing concentrations of absolute ethanol (85% down to 28% by volume), and a constant concentration of water (15% by volume) to produce samples containing a constant total alcohol (IPA plus ethanol) concentration of 85% by volume. Small scale free-burning tests were carried out in open aluminum cups as in the Examples above utilizing 2.0 milliliter samples of each solution. Soot production was monitored by the formation of an opaque black deposit in a 30 second time interval on a water-cooled stainless steel tray suspended directly above the flame. Results (with flame color and soot production) were as follows:

| Sample | % IPA (by vol) | % ethanol (by vol) | % water (by vol) | Description of Flame and Soot |
|---|---|---|---|---|
| 1. | 0 | 85 | 15 | colorless flame, no soot |
| 2. | 10 | 75 | 15 | yellow flame, no Soot |
| 3. | 20 | 65 | 15 | yellower flame than #2, no soot |
| 4. | 30 | 55 | 15 | similar to #3 |
| 5. | 40 | 45 | 15 | similar to #3, bare trace of soot |
| 6. | 50 | 35 | 15 | similar to #3, thin coating of soot |
| 7. | 57 | 28 | 15 | similar to #3, opaque soot deposit |

Conclusions: Again, 10–20% by volume IPA provides good flame coloration in an 85% by volume alcohol fuel composition (total IPA plus ethanol content) containing 15% water. A remarkably large proportion of IPA does not cause substantial production of soot. For example, in sample 6, in which the IPA concentration actually exceeds the ethanol concentration by almost 1.5:1, only a small amount of soot is produced.

Those skilled in the art will recognize that the present invention can be carried out using a variety of concentrations of alcohols and water as described above, and will also recognize that other components can be added to the fuel composition for particular applications. For example, odorizers and/or liquid colorants may be advantageous for use with liquid fuel compositions to provide added safety, such as to indicate that the mixture is not an ingestible alcohol solution. Such additions and variations are within the scope of the claims of the present invention.

Other features and embodiments are within the following claims.

What we claim is:

1. A method for enhancing and sustaining the visibility of a flame produced during free-burning of an aqueous alcohol-based fuel composition in air, comprising the step of:

providing a said fuel composition comprising between approximately 70% and 90% by volume of a mixture of alcohols and between approximately 10% and 30% by volume of water, wherein said mixture of alcohols comprises an amount of isopropanol between approximately 7% and 60% by volume of said fuel composition and an amount of ethanol between approximately 24% and 83% by volume of said fuel composition, and wherein the volume ratio of said isopropanol to said ethanol in the fuel does not exceed 2:1 wherein said enhancing the visibility of a flame is provided by the mixture of said isopropanol and said ethanol and, wherein said fuel composition is substantially free of skin-irritants, corrosive salts and agents which, when burned in air, produce air pollution evidenced by the production of volatile organic compounds.

2. The method of claim 1, wherein said fuel composition comprises between approximately 10% and 20% by volume water, and between 80% and 90% by volume of a mixture of alcohols, wherein said mixture of alcohols comprises ethanol and isopropanol, said ethanol constituting between approximately 27% and 83% by volume of said fuel composition and said isopropanol constituting between approximately 7% and 53% by volume of said fuel composition.

3. The method of claim 1, wherein said fuel composition further comprises a thickening agent which reduce the flow and seepage rate of said fuel, and which is able to at least partially immobilize said fuel after said fuel has been transferred from its storage container to the location where it is to be burned.

4. The method of claim 3, wherein said thickening agent is a hydrocolloid thickening agent.

5. The method of claim 4, wherein said thickening agent is a cellulosic thickening agent which is soluble in a fuel composition containing up to 90% by volume of said mixture of alcohols.

6. The method of claim 5, wherein said thickening agent is hydroxypropylcellulose.

7. A fuel composition providing enhanced flame visibility on combustion, comprising between approximately 70% and 90% by volume of a mixture of alcohols and between approximately 10% and 30% by volume of water, wherein said mixture of alcohols comprises an amount of isopropanol between approximately 7% and 60% by volume of said fuel composition and an amount of ethanol between approximately 24% and 83% by volume of said fuel composition, and wherein the volume ratio of said isopropanol to said ethanol in the fuel does not exceed 2:1, wherein said fuel composition is substantially free of skin-irritants, corrosive salts and agents which, when burned in air, produce air pollution evidenced by the production of volatile organic compounds.

8. The fuel composition of claim 7, wherein said composition comprises between approximately 10% and 20% by volume water, and between 80% and 90% by volume of a mixture of alcohols, wherein said mixture of alcohols comprises ethanol and isopropanol, said ethanol constituting between approximately 27% and 83% by volume of said fuel composition and said isopropanol constituting between approximately 7% and 53% by volume of said fuel composition.

9. The fuel composition of claim 7, further comprising a thickening agent which reduces the flow and seepage rate of said fuel, and which is able to at least partially mmobilize said fuel after said fuel has been transferred from its storage container to the location where it is to be burned.

10. The fuel composition of claim 9, wherein said thickening agent is a hydrocolloid thickening agent.

11. The fuel composition of claim 10, wherein said thickening agent is a cellulosic thickening agent which is soluble in a fuel composition containing up to 90% by volume of said mixture of alcohols.

12. The fuel composition of claim 11, wherein said thickening agent is hydroxypropylcellulose.

13. The fuel composition of claim 7, wherein said fuel composition consists essentially of said ethanol, said isopropanol, and said water.

14. The fuel composition of claim 9, wherein fuel composition consists essentially of said ethanol, said isopropanol, said water, and said thickening agent.

* * * * *